US008008560B2

(12) United States Patent
Wiese et al.

(10) Patent No.: US 8,008,560 B2
(45) Date of Patent: Aug. 30, 2011

(54) MUSICAL SYSTEM

(75) Inventors: Michael A. Wiese, Austin, TX (US); Eric Douglas Holland, Wimberley, TX (US); Edwin Ray Barbee, Austin, TX (US)

(73) Assignee: Swan Percussion, LLC, Austin, TX (US)

( * ) Notice: Subject to any disclaimer, the term of this patent is extended or adjusted under 35 U.S.C. 154(b) by 0 days.

(21) Appl. No.: 12/711,914

(22) Filed: Feb. 24, 2010

(65) Prior Publication Data

US 2010/0212474 A1 Aug. 26, 2010

Related U.S. Application Data

(60) Provisional application No. 61/155,345, filed on Feb. 25, 2009.

(51) Int. Cl.
*G10D 13/02* (2006.01)

(52) U.S. Cl. ..... 84/411 R

(58) Field of Classification Search ..... 84/411 R, 84/413

See application file for complete search history.

(56) References Cited

U.S. PATENT DOCUMENTS

| | | | | | |
|---|---|---|---|---|---|
| 769,527 | A | * | 9/1904 | Bahr | 84/411 R |
| 769,528 | A | * | 9/1904 | Bahr | 84/411 R |
| 1,916,123 | A | * | 6/1933 | Greenleaf | 84/419 |
| 2,026,444 | A | * | 12/1935 | Trott | 180/293 |
| D100,734 | S | * | 8/1936 | Lira | D17/22 |
| 2,074,193 | A | * | 3/1937 | Strupe | 84/411 R |
| 2,495,450 | A | * | 1/1950 | Gladstone | 84/411 R |
| 2,548,271 | A | * | 4/1951 | Percy | 84/411 R |
| 2,729,133 | A | * | 1/1956 | Ludwig | 84/419 |
| 2,858,724 | A | * | 11/1958 | Troppe | 84/411 R |
| 3,215,019 | A | * | 11/1965 | Sloan | 84/269 |
| 3,376,777 | A | * | 4/1968 | Becker-Ehmck | 84/419 |
| 3,685,389 | A | * | 8/1972 | Bemben | 84/411 R |
| 4,026,185 | A | * | 5/1977 | Migirian | 84/411 R |
| 4,048,895 | A | * | 9/1977 | May | 84/411 A |
| 4,122,748 | A | * | 10/1978 | May | 84/411 A |
| 4,122,749 | A | * | 10/1978 | Hoellerich | 84/419 |
| D267,014 | S | * | 11/1982 | Migirian | D17/22 |
| 4,549,462 | A | * | 10/1985 | Hartry et al. | 84/413 |
| 4,583,442 | A | * | 4/1986 | Minor | 84/413 |
| D288,696 | S | * | 3/1987 | Hoshino | D17/22 |
| D296,447 | S | * | 6/1988 | Jowitt | D17/22 |
| 4,831,912 | A | * | 5/1989 | Allen | 84/419 |
| 4,909,125 | A | * | 3/1990 | Fece | 84/411 A |
| 5,157,212 | A | * | 10/1992 | Fleming | 84/413 |
| 5,375,500 | A | * | 12/1994 | Halpin | 84/413 |

(Continued)

OTHER PUBLICATIONS

History of the Cajón (viewed Mar. 13, 2008 at www.cajondg.com/en/products/history.html).*

(Continued)

*Primary Examiner* — Elvin G Enad
*Assistant Examiner* — Robert Horn
(74) *Attorney, Agent, or Firm* — Mark E. Scott; Conley Rose, P.C.

(57) ABSTRACT

A musical system. At least some of the illustrative embodiments are systems including: a frame with an interior cavity, a tuning system coupled within the interior cavity of the frame, the tuning system configured to be accessed by way of an aperture through of the frame, and a drum head retained at a first end of the frame, wherein the tuning system configured to apply uniform pressure that circumscribes an axis of interior surface of the drum head.

23 Claims, 4 Drawing Sheets

U.S. PATENT DOCUMENTS

| | | | | |
|---|---|---|---|---|
| 5,385,075 | A * | 1/1995 | Carnes et al. | 84/411 R |
| 5,487,320 | A * | 1/1996 | De Mowbray | 84/413 |
| 5,517,890 | A * | 5/1996 | Cooperman | 84/411 R |
| 5,936,175 | A * | 8/1999 | Simons | 84/413 |
| 6,043,421 | A * | 3/2000 | Adams | 84/419 |
| 6,057,499 | A * | 5/2000 | Basmadjian | 84/411 R |
| 6,410,833 | B1 * | 6/2002 | Brando | 84/411 R |
| 6,441,286 | B1 * | 8/2002 | Brando et al. | 84/411 R |
| 6,492,583 | B1 * | 12/2002 | Wilkey | 84/413 |
| 6,570,074 | B1 * | 5/2003 | Rode | 84/413 |
| 6,667,432 | B2 * | 12/2003 | Brando | 84/411 R |
| 6,747,199 | B2 * | 6/2004 | Shah | 84/411 R |
| 6,812,392 | B2 * | 11/2004 | Brando | 84/411 R |
| 6,949,702 | B2 * | 9/2005 | Ortega et al. | 84/413 |
| 7,268,283 | B1 * | 9/2007 | Sikra | 84/421 |
| D571,851 | S * | 6/2008 | Myers | D17/22 |
| 7,482,522 | B2 * | 1/2009 | Wening | 84/415 |
| 7,485,790 | B2 * | 2/2009 | Payerl | 84/411 R |
| 7,488,882 | B2 * | 2/2009 | Curet Troche | 84/411 R |
| 7,601,901 | B2 * | 10/2009 | Payerl | 84/411 R |
| 7,692,083 | B2 * | 4/2010 | Aspland | 84/415 |
| 7,718,877 | B2 * | 5/2010 | Swinkels | 84/411 R |
| 7,799,981 | B1 * | 9/2010 | Curet Troche | 84/411 R |
| 7,816,596 | B2 * | 10/2010 | Bottger | 84/411 R |
| 2008/0034944 | A1 * | 2/2008 | Aspland | 84/415 |
| 2010/0212474 | A1 * | 8/2010 | Wiese et al. | 84/413 |

OTHER PUBLICATIONS

Salwender International Percusion, including polygonal music systems, viewed www.salwender.com/Cajon.htm on Mar. 13, 2008.*

* cited by examiner

MUSICAL SYSTEM

CROSS-REFERENCE TO RELATED APPLICATIONS

This specification is a Non-Provisional of application Ser. No. 61/155,345, filed Feb. 25, 2009, titled "A Musical System", which application is incorporated by reference herein as if reproduced in full below.

BACKGROUND

When percussionists travel to perform at various locations, the percussionists transport a great deal of heavy and cumbersome musical equipment. The various devices are needed to provide a variety of sounds and tones during the performance. The devices are delicate, sensitive, and require both time and tools to adjust the equipment to provide the variety of sounds and tones. It would be helpful to a percussionist to travel with musical equipment that is versatile and easy to adjust.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, oilfield service companies may refer to a component by different names. This document does not intend to distinguish between components that differ in name but not function.

In the following discussion and in the claims, the terms "including" and comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

"Straddling" shall mean to stand astride or sit astride.

"Circumference" shall mean boundary of any shape such as, a circle, a square, or a rectangle.

DETAILED DESCRIPTION

The following discussion is directed to various embodiments. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
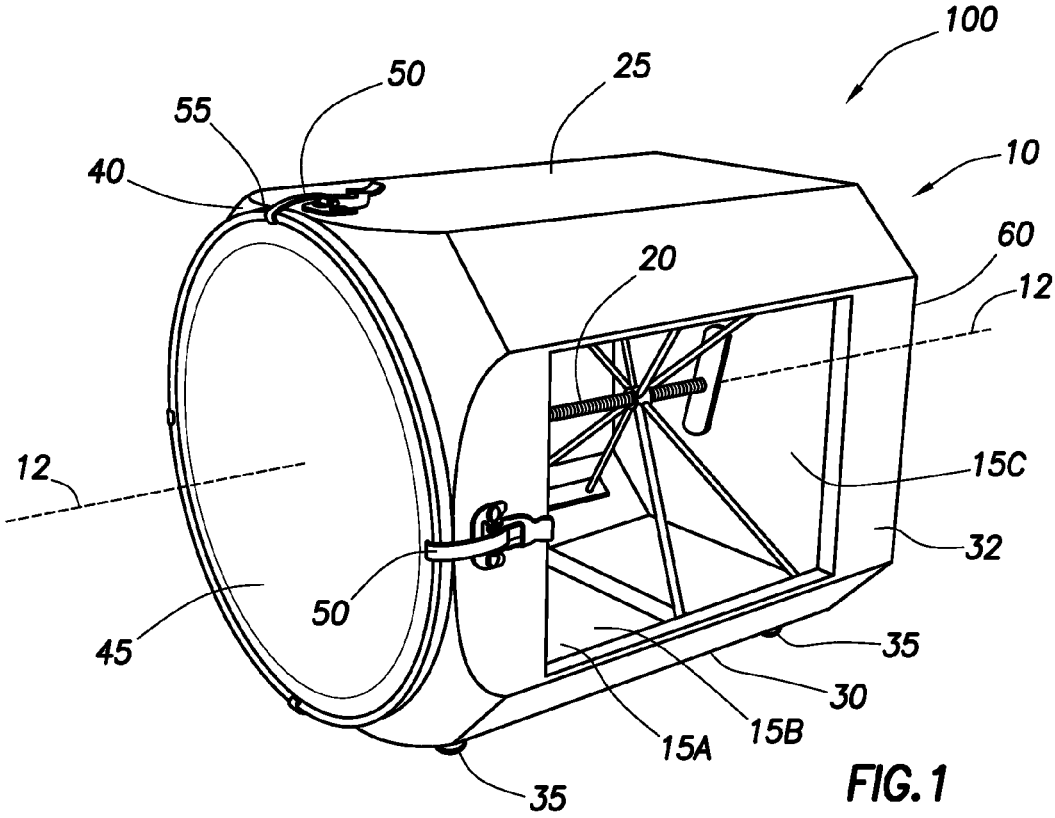
FIG. 1 shows a perspective view of a musical system in accordance with at least some of the embodiments.

FIG. 1 shows a musical system 100 in accordance with at least some of the embodiments. In particular, FIG. 1 shows a perspective view of the musical system 100 comprising a frame 10 that defines a polygonal cross section and an axis 12 with a top surface 25, a bottom surface 30 and a plurality of side surfaces 32. In the particular embodiment, the frame 10 also comprises apertures 15 through the bottom surface 30 and the side surfaces 32. The top surface 25 of the frame 10 is substantially flat, and the top surface 25 does not comprise an aperture. In other embodiments, the top surface 25 is not flat. Regardless of the top surface 25, in the various embodiments, the top surface 25 is configured to allow a user to straddle the frame 10 and play the musical system 100. Consider for purpose of explanation that the musical system 100 is a drum, the top surface 25 is configured to allow the user to straddle the drum, and afford comfort while seated to play the drum. In other embodiments, padding may be disposed on the top surface 25 of the frame 10 to provide additional comfort, and to prevent the user from sliding. The frame 10 is constructed from wood or any materials with properties similar to wood. In some embodiments, the frame 10 also serves as an additional playing surface offering an additional tone when struck. In alternative embodiments, the frame 10 may define any suitable cross section, such as a circular cross section or a quadrilateral cross section.

A plurality of legs 35 are coupled to (e.g., threadingly, glued or snap-fit) the bottom surface 30 of the frame member 10. In some embodiments, height of each of the plurality of legs 35 may be adjusted to stabilize the musical system 100 on a surface (e.g., a stage or a riser) upon which the musical system is placed. The plurality of legs 35 may be any type of legs, such as vinyl clad, metal, rubber, or spiked. In some embodiments, each of the plurality of legs 35 may include a dampener and/or an isolator to reduce the translation of the vibrations caused by the musical system 100 to the surface.

In some embodiments, a drum head 45 is retained at an end 40 of the frame 10 by way of a plurality of latches 50 (e.g., draw latches). In the particular embodiment, the drum head 45 and the end 40 of the frame 10 are of circular shape and define the axis 12; however, in other embodiments, the drum head 45 and the end 40 may be of any shape such as a square, a rectangle or a polygon. In the exemplary embodiments, the drum head 45 has a diameter of approximately 16 inches, and the drum head 45 may be constructed from various synthetic and/or natural materials (e.g., Calfskin, Mylar, or Kevlar).

In some embodiments, a retaining ring 55 is disposed along the end 40 of the frame member 10 to retain the drum head 45, and the retaining ring 55 has a shape that corresponds with shape of the end 40 of the frame 10. For example, the retaining ring 55 is a circular ring if the end 40 also has a circular shape. The drum head 45 may be replaced by releasing the latches 50, and removing the retaining ring 55 disposed along the perimeter of the drum head 45. Combined the retaining ring 55 and latches 50 are configured to apply uniform pressure on the drum head 45 when the drum head 45 is retained to the end 40. The retaining ring 55 is may be constructed from any suitable materials, such as cold rolled steel. In the particular embodiment, latches 50 retain the retaining ring 55 and the drum head 45 to the end 40; however, a threaded ring may equivalently be used. In some embodiments, the retaining ring 55 when secured to the end 40, in addition to retaining the drum head 45, may be struck to provide a musical tone. In the embodiments of FIG. 1, the curvature of the frame 10 at the end 40 allows a user to access the entire outside surface of the drum head 45, and the curvature of the frame 10 at the end 40 also serves as a comfortable, ergonomic hand rest.

In some embodiments, a tuning system 20 is disposed within the interior cavity of the frame 10 by coupling (e.g., using fasteners) the tuning system 20 to the interior surface of the frame 10. The tuning system 20 abuts the interior surface of the drum head 45 to apply uniform pressure that circumscribes the axis 12 of the interior surface of the drum head 45. The tuning system 20 is accessible through the apertures 15 such that, in the particular embodiment, the musical system 100 may be tuned while the musical system 100 is straddled. For example, the user may straddle the frame 10 and access the tuning system 20 by way of the aperture 15 through the end 60 or the aperture 15 through the side surfaces 32.

Figure 2A:
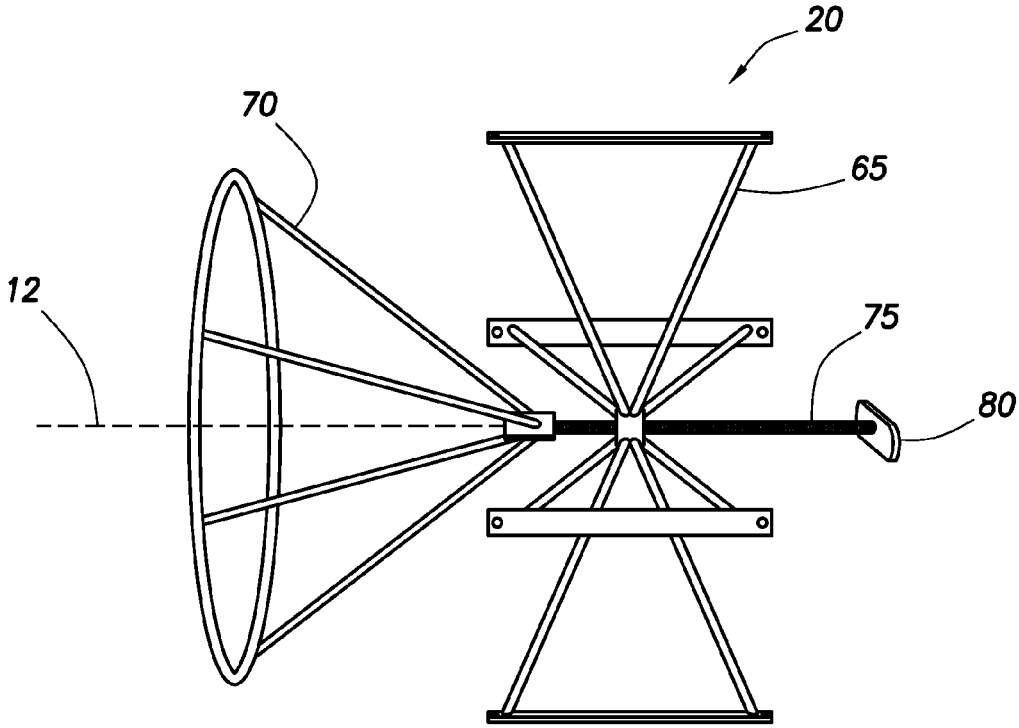
FIG. 2A shows a side perspective view of a tuning system in accordance with at least some embodiments.

FIG. 2A shows the tuning system 20 of the musical system 100 in accordance with at least some of the embodiments. In particular, FIG. 2A shows a side perspective view of the tuning system 20 comprising a tuning structure 65, a tuning ring assembly 70 and a tuning rod 75. The tuning structure 65 is configured to couple the tuning system 20 to the interior cavity of frame 10, and provide structural stability to the frame 10. The tuning ring assembly 70 abuts with the interior surface of the drum head 45 to apply uniform pressure that circumscribes the axis 12 of the interior surface of the drum head 45. The tuning rod 75 couple to the tuning structure 65 and the tuning ring assembly 70, and the tuning rod 75 fixes the tuning ring assembly 70 against the interior surface of the drum head 45. The tuning rod 75 comprises at an end opposite the tuning ring assembly 70 a handle 80 to rotate the tuning rod 75. The rotation of the tuning rod 75 changes the pressure applied by the tuning ring assembly 70 to the interior surface of the drum head 45, and thus tunes the musical system 100 to a desired tone. The tuning system 20 may be constructed from any suitable materials, such as cold rolled steel.

Figure 2B:
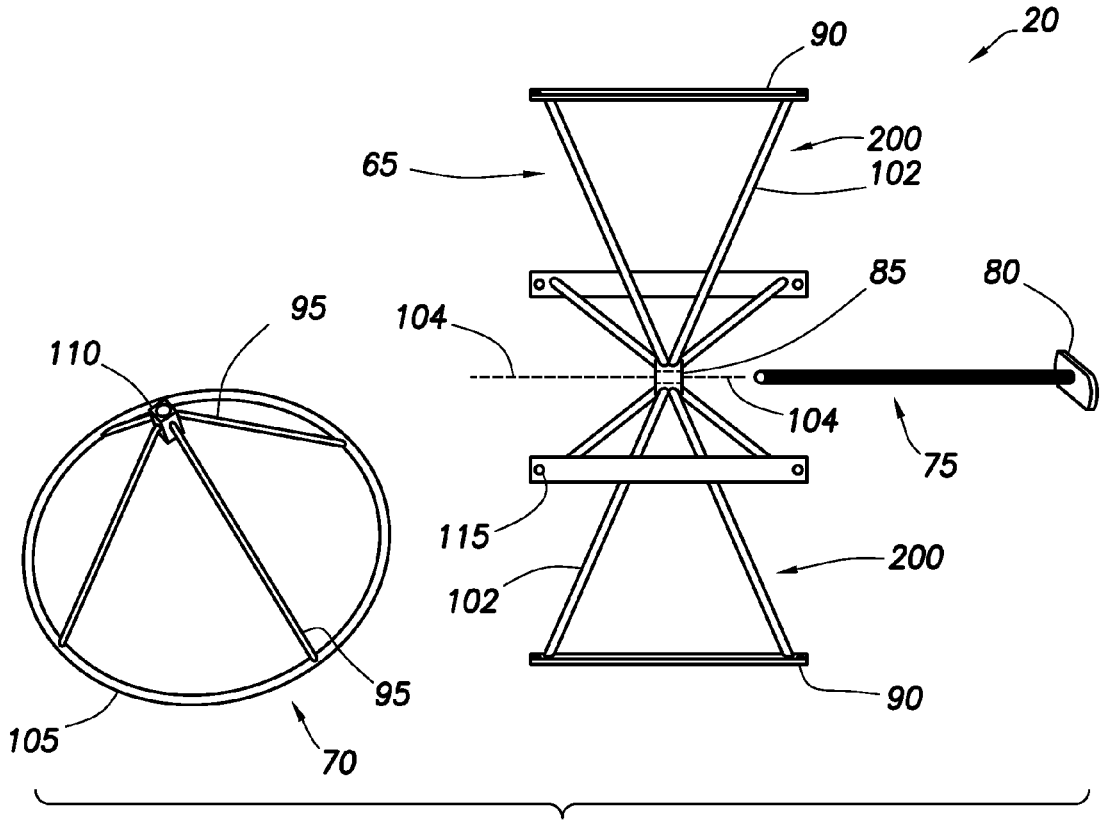
FIG. 2B shows a perspective view of the components of a tuning system in accordance with at least some embodiments.

FIG. 2B shows a perspective view of the components of the tuning system 20 comprising the tuning structure 65, the tuning ring assembly 70 and the tuning rod 75. The tuning structure 65 comprises a plurality of mounts 200 that couple to a set nut 85 that defines the axis 104 of the tuning structure 65. In some embodiments, the axis 104 is parallel with the axis 12, and in other embodiments, axis 104 is same as the axis 12. The set nut 85 comprises a threaded interior and the mounts 200 extend radially from the set nut 85. In the particular embodiment, the tuning structure 65 comprises four mounts 200 spaced substantially the same distance from each other; however, in other embodiments the tuning structure 65 may comprise any number of mounts 200 spaced at any distance. Each of the mounts 200 comprises struts 102 and a mounting plate 90. The struts 102 are coupled (e.g., by way of welding) to the set nut 85 at a first end, the struts 102 extend radially from the set nut 85 and the struts 102 are coupled (e.g., by way of welding) to the mounting plate 90 at a second end.

The mounting plates 90 comprise a plurality of apertures 115 to couple the tuning structure 65 to the frame 10. In some embodiments, the apertures 115 of the mounting plate 90 receive a fastener (e.g., a screw, or a nail) to couple the tuning structure 65, and thus, the tuning system 20, to frame 10. The tuning structure 65 is configured to provide structural stability, and to reinforce the frame 10 increasing the load bearing capacity of the frame 10. For example, the frame 10 with tuning structure 65 coupled within the interior cavity of the frame 10 can withstand a static load of up to 400 lbs, and a dynamic load of up to 275 lbs.

In some embodiments, the tuning rod 75 is configured to telescope through the set nut 85 by way of a threaded connection. For example, the tuning rod 75 telescopes through the set nut 85 by way of a threaded connection that comprises at least seven threads along the interior of the set nut 85. In alternative embodiments, an elongated set nut 85 may be incorporated into tuning structure 65 to increase drag and bearing capacity to allow for more aggressive play. The tuning rod 75 telescopes through set nut 85 such that the tuning rod 75 is concentric with the tuning ring assembly 70, and in turn, the tuning ring assembly 70 in turn is concentric with the drum head 45. Moreover, the telescoping of the tuning rod 75 through the set nut 85 prevents the tuning ring assembly 70 from shifting across the interior surface of the drum head 45 when the musical system is being played. In some embodiments, the tuning rod 75 is rotated by way of the handle 80 to change the pressure applied by the tuning ring assembly 70 around the circumference of the interior surface of the drum head 45, and thus tune the musical system 100 to a desired tone.

The tuning ring assembly 70 is configured to apply uniform pressure that circumscribes the axis 12 of the interior surface of the drum head 45. The tuning ring assembly 70 comprises a pressure ring 105 at a first end and a receiving socket 110 at a second end opposite the first end. In the particular embodiment, the tuning ring assembly 70 also comprises a plurality of struts 95 coupled (e.g., by way of welding) to the pressure ring 105. The plurality of struts 95 extend from the pressure ring 105 and converge to couple (e.g., by way of welding) to the receiving socket 110. The plurality of struts 95 are spaced equally apart along the circumference of the pressure ring 105. The receiving socket 110 is configured to receive the tuning rod 75 after the tuning rod 75 has telescoped through the set nut 85. In some embodiments, the receiving socket 110 and the tuning rod 75 mate by way of a slip connection such that the slip connection prevents the pressure ring 105 from rotating against the interior surface of the drum head 45 when the tuning rod 75 is rotated to tune the musical system. In other embodiments, the receiving socket 110 is oversized with respect to the tuning rod 75 to prevent the pressure ring 105 from rotating against the drum head 45 when the tuning rod 75 is rotated to tune the musical system.

Figure 2C:
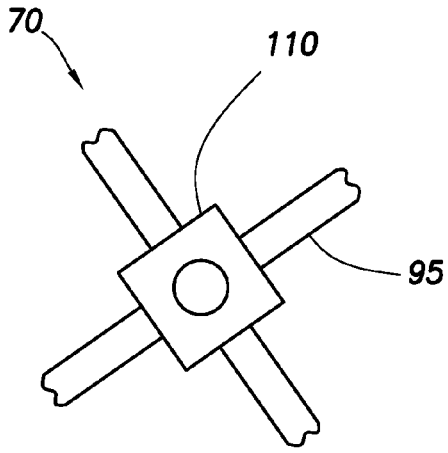
FIG. 2C shows a receiving socket in accordance with at least some embodiments.

FIG. 2C shows a detailed view of the receiving socket 110 in accordance with some of the embodiments. In particular, FIG. 2C shows the plurality of struts 95 coupled (e.g., by way of welding) to the receiving socket 110. The interior of the receiving socket 110 is beveled and milled smooth to reduce friction between the tuning rod 75 and the receiving socket 110 when the tuning rod 75 is rotated. In some embodiments, a vinyl bushing/spacer may be disposed within the receiving socket 110 to reduce vibrations between the tuning ring assembly 70, and the tuning rod 75.

Figure 2D:
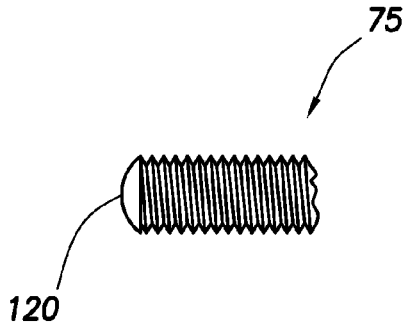
FIG. 2D shows a tuning rod in accordance with at least some embodiments.

FIG. 2D shows the end 120 opposite to the handle 80 of the tuning rod 75 in accordance with some of the embodiments. In the particular embodiment, the tuning rod 75 is threaded along the entire length of the tuning rod 75, and the tuning rod 74 is constructed from suitable materials, such as cold rolled steel. The end 120 of the tuning rod 75 is milled smooth to reduce friction between the tuning rod 75 and the receiving socket 110 when the tuning rod 75 is rotated.

Figure 3:
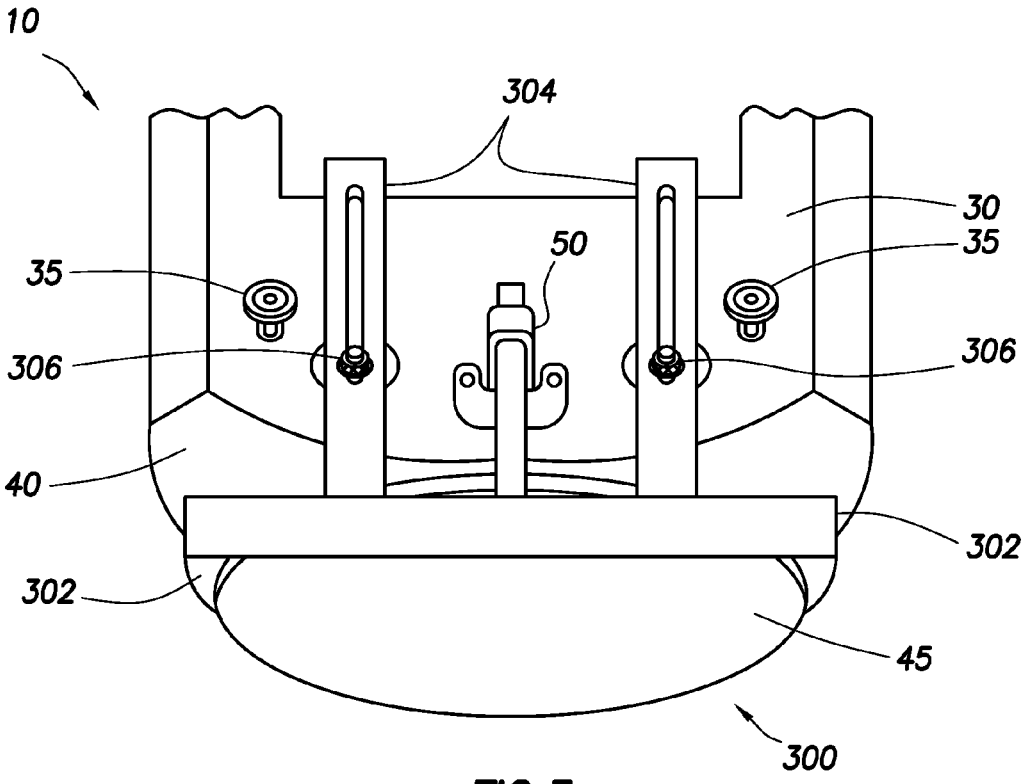
FIG. 3 shows a perspective view of a musical system with a pedal bracket in accordance with at least some of the embodiments.

FIG. 3 shows a musical system 300 similar to the embodiments of FIG. 1, but the musical system 300 comprises a pedal bracket 302. In particular, the pedal bracket 302 is a 'π' shaped bracket with slotted tabs 304. The pedal bracket 302 is coupled proximate to the end 40 and the bottom surface 30 of the frame 10. In some embodiments, the pedal bracket is 302 is coupled to the bottom surface 30 of the frame 10 by applying fasteners 306 through the slotted tabs 304. For example, the pedal bracket 302 is coupled by applying knurled nuts with washers through the slotted tabs 304. The slotted tabs 304 are configured to enable the pedal bracket 302 to be secured at any suitable location across the bottom surface 30 of the frame 10. In some embodiments, the pedal bracket 302 is configured to accept a bass drum pedal, and the slotted tabs 304 are configured to enable the bass pedal to move to any suitable location across the surface of the drum head 45 to achieve the desired tone. The base drum pedal can be played independently or in conjunction with other means including such as hands, sticks, and brushes. In some embodiments, the pedal bracket 302 is constructed from suitable materials, such as steel. A plurality of dampeners and/or isolators may be also disposed between the slotted tabs 304 and the frame 10.

In alternative embodiments, the pedal bracket 302 may be coupled to other surfaces of the frame 10, such as the top surface or the side surfaces. In other embodiments, the pedal bracket 302 may be coupled at an angle to the end 40 of the frame 10 to allow mounting of two bass drum pedals of varying size on the sides of the drum head 45. In yet still other embodiments, automated controls could be added to bass pedals to allow them to operate independently.

Figure 4:
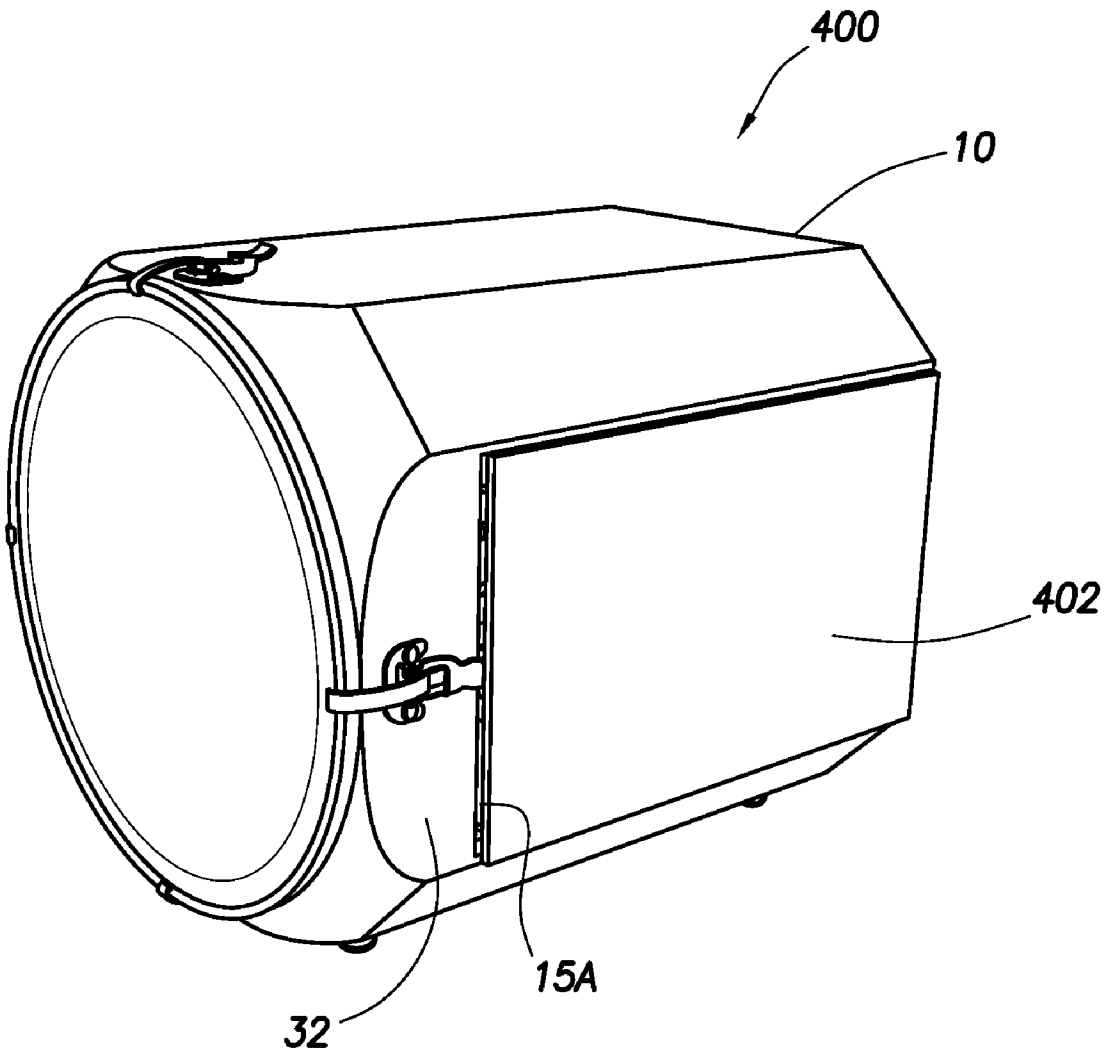
FIG. 4 shows a perspective view of a musical system with a slap panel in accordance with at least some of the embodiments.

FIG. 4 shows a musical system 400 similar to the embodiments of FIG. 1, but the musical system 400 comprises a slap panel 402. In the particular embodiments, the slap panel 32 is coupled to at least one of the side surfaces 32 such that the slap panel covers the aperture 15 through the at least one of the side surfaces 32. The slap panel 402 also provides an additional playing surface. The slap panel 402 can be constructed from any material, such as plywood, metal or polymer-based synthetics. In other embodiments, snare springs, bells, and resonators may be fastened to, or hung from the frame 10 and/or panels to provide additional sound effects. Additionally, a microphone may be coupled to the frame 10 at any suitable location. The microphone may be coupled by way of any means such as by way of drilling holes, adding threaded inserts or installing a bracket.

Figure 5:
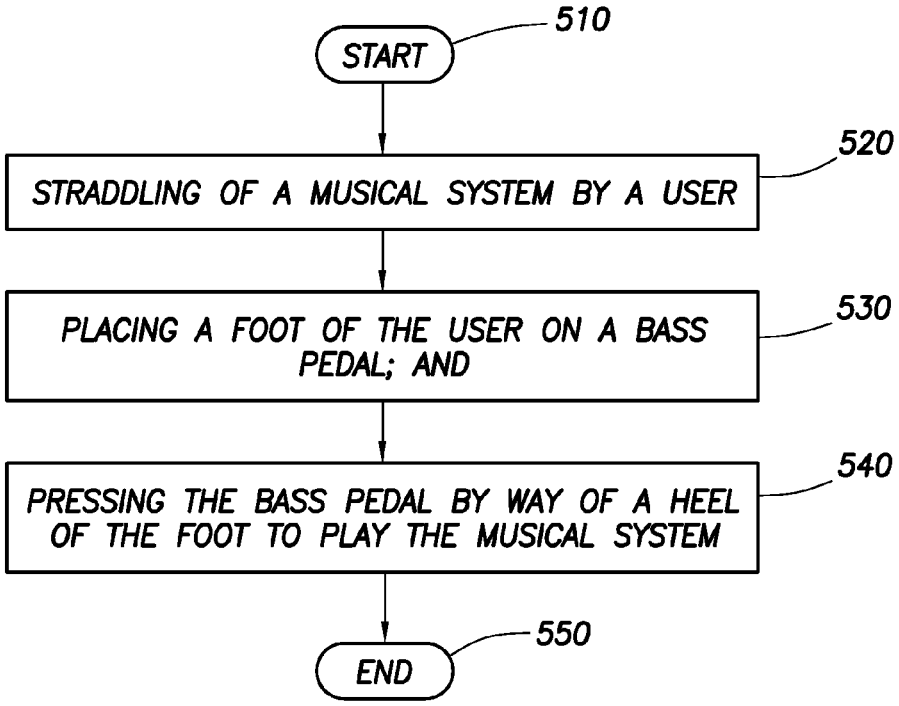
FIG. 5 shows a method in accordance with at least some of the embodiments.

FIG. 5 shows a method of playing the musical system in the embodiments of FIG. 1 and FIG. 3. In particular, the method starts (block 510), and the user straddles the musical system (block 520). Thereafter, the user places a foot on bass pedal (block 530). In some embodiments, the base pedal is coupled to the pedal bracket shown in the embodiments of FIG. 3. Finally, the user presses the bass pedal by way of the heel of the foot to play the musical system (block 540), and the method ends (block 550).

In alternative embodiments, both the end 60 and the end 40 of the frame 10 may be similar and configured to retain a drum head at each of the end 40 and end 60 of the frame 10. The drum heads could have independent tuning systems 20 accessed through the apertures 15 of the frame 10. A user could sit in direction perpendicular to the end 40 and the end 60 play the musical system 100.

In other embodiments, the tuning system 20 can be mechanized through use of servo motors, hydraulic means, and pneumatic means. Additionally, a foot pedal can be added to control tuning adjustments and to allow the user to adjust tuning settings while playing the musical system 100. In yet still other embodiments, the mechanized tuning system 20 may be automatically calibrated to match the pitch with accompanying instruments and vocals. For example, sensors may be coupled with a mechanized tuning system 20 to allow the musical system 100 to self adjust to the desired pitch.

The above discussion is meant to be illustrative of the principles and various embodiments of the present invention. Numerous variations and modifications will become apparent to those skilled in the art once the above disclosure is fully appreciated. For example, the musical system 100 as defined may be adapted to incorporate any skin or synthetic drum head regardless of size and application. The musical system 100 may be utilized in upright, shoulder sling, and frame mount drums. The musical system 100 could also be mounted on a resonant stage to amplify the sound of the musical system 100.

What is claimed is:

1. A musical system comprising:

a frame with an interior cavity;

a tuning system coupled within the interior cavity of the frame, the tuning system configured to be accessed by way of an aperture through of the frame;

a drum head disposed at a first end of the frame;

a retaining ring disposed on the outer surface of the drum head; and a plurality of latches coupled to the frame and proximate to the first end, the plurality of latches configured to retain the drum head and the retaining ring against the first end of the frame;

wherein the tuning system is configured to apply uniform pressure that circumscribes an axis of interior surface of the drum head.

2. The musical system as defined in claim 1 wherein the frame defines a polygonal cross section with a top surface, a bottom surface, and a plurality of side surfaces.

3. The musical system as defined in claim 2 wherein the tuning system is configured to be accessed by way of an aperture through at least one selected from the group consisting of: the plurality of side surfaces; and a second end opposite the first end.

4. The musical system as defined in claim 2 further comprising a slap panel coupled to the least one of the plurality of side surfaces, the slap panel at least partially covers an aperture through the at least one of the plurality of side surfaces.

5. The musical system as defined in claim 1 wherein the tuning system comprises:

a tuning ring assembly that abuts an inside surface of the drum head;

a tuning structure that couples to the frame; and a tuning rod coupled to the tuning structure and the tuning ring assembly, the tuning rod fixes the tuning ring assembly against the drum head.

6. The musical system as defined in claim 5 wherein the tuning structure comprises:

a set nut that defines an axis of the tuning structure;

a plurality of struts coupled to the set nut and the plurality of struts extend radially from the set nut; and a plurality of mounting plates, wherein each of the plurality of mounting plates is coupled to at least one of the plurality of struts, and wherein the plurality of mounting plates couple the tuning system within the interior cavity of the frame.

7. The musical system as defined in claim 6 wherein the tuning rod is telescoped through the set nut of the tuning structure, the tuning rod comprises at an end opposite the tuning ring assembly a handle configured to rotate the tuning rod.

8. The musical system as defined in claim 5 wherein the tuning ring assembly comprises:

a pressure ring at a first end;

a receiving socket at a second end, the receiving socket configured to receive the tuning rod; and a plurality of struts coupled to the tuning ring, the plurality of struts extend away from the pressure ring and couple to the receiving socket;

wherein the tuning ring assembly configured to apply the uniform pressure that circumscribes the axis of the interior surface of the drum head; and wherein the mechanical coupling between the tuning rod and the receiving socket is a slip connection such that the pressuring ring remains rotationally stationary relative to the drumhead when the tuning rod is turning about a long axis.

9. The musical system as defined in claim 5 further comprising pedal mount proximate to the second end of the frame and the pedal mount coupled to the bottom surface of the frame, wherein the pedal mount is configured to receive a bass pedal.

10. The musical system as defined in claim 1 further comprising a plurality of adjustable legs coupled to the bottom surface of the frame.

11. The musical system of claim 1 wherein each of the plurality of latches further comprises a draw latch.

12. A system comprising:

a tuning system disposed within an interior cavity of a frame of a musical system, the tuning system comprising:

a tuning ring assembly that comprises a plurality of struts and a receiving socket;

a tuning structure that comprises a set nut that defines an axis of the tuning structure, and a plurality of mounting plates configured to couple the tuning system to the frame, the set nut rigidly affixed to the tuning structure; and a tuning rod that telescopes through the set nut and the tuning rod and is received by the receiving socket of the tuning ring assembly, wherein the tuning rod comprises at an end opposite the receiving socket a handle configured to rotate the tuning rod, and the mechanical coupling between the tuning rod and the receiving socket is such that the tuning ring remains rotationally stationary when the tuning rod is turning about a long axis.

13. The system as defined in claim 12 wherein the tuning ring assembly further comprises:

a pressure ring at a end opposite the receiving socket;

wherein the plurality of struts are coupled to the tuning ring, the plurality of struts extend from the pressure ring and couple to the receiving socket, and wherein the tuning ring assembly configured to apply uniform pressure that circumscribes an axis of the interior surface of a drum head coupled to the frame.

14. The system as defined in claim 12 wherein the interior of the receiving socket is beveled and milled smooth.

15. The system as defined in claim 12 wherein the tuning rod is threaded along the entire length, and the tuning rod threadingly telescopes through the set nut.

16. The system as defined in claim 12 wherein the tuning structure further comprises:

a plurality of struts coupled to the set nut and the plurality of struts extend radially from the set nut; and, wherein each of the plurality of mounting plates is coupled to at least one of the plurality of struts.

17. The system as defined in claim 12 wherein each of the plurality of mounting plates comprises an aperture configured to receive a fastener.

18. A method for operating a drumming system, the system comprising a diaphragm stretched over a boxy shell, the shell comprising flat sides and a top suitable for sitting, the system comprising a bass drum pedal adjacent the diaphragm, the method comprising:

straddling of the drumming system by user;

placing a foot of the user on a bass pedal;

pressing the bass pedal by way of a heel of the foot to play the musical diaphragm; and slapping on the flat sides by hand by the user to play the sides.

19. The method as defined in claim 18 further comprising accessing, by way of an aperture in the musical system, a tuning system that is disposed within interior cavity of the musical system, the accessing while the user is straddling the musical system.

20. The method as defined in claim 19 wherein the accessing further comprises tuning the musical system by rotating a tuning rod of the tuning system while the user is straddling the musical system.

21. A musical system comprising:

a frame with an interior cavity;

a drum head disposed at a first end of the frame;

a tuning system coupled within the interior cavity of the frame, the tuning system configured to be accessed by way of an aperture through the frame, the tuning system comprising:

a tuning ring assembly that abuts an inside surface of the drum head;

a tuning structure that couples to the frame; and a tuning rod coupled to the tuning structure and the tuning ring assembly, the tuning rod fixes the tuning ring assembly against the drum head;

wherein the tuning system is configured to apply uniform pressure that circumscribes an axis of interior surface of the drum head;

a retaining ring disposed on the outer surface of the drum head; and a plurality of draw latches coupled to the frame and proximate to the first end, the plurality of draw latches configured to retain the drum head and the retaining ring against the first end of the frame.

22. The musical system as defined in claim 21 wherein the tuning structure further comprises:

a set nut that defines an axis of the tuning structure, the set nut rigidly affixed to the tuning structure;

a plurality of struts coupled to the set nut and the plurality of struts extend radially from the set nut; and a plurality of mounting plates, wherein each of the plurality of mounting plates is coupled to at least one of the plurality of struts, and wherein the plurality of mounting plates couple the tuning system within the interior cavity of the frame.

23. The musical system as defined in claim 21 wherein the tuning ring assembly comprises:

a pressure ring at a first end;

a receiving socket at a second end, the receiving socket configured to receive the tuning rod; and a plurality of struts coupled to the tuning ring, the plurality of struts extend away from the pressure ring and couple to the receiving socket;

wherein the mechanical coupling between the tuning rod and the receiving socket is a slip connection such that the pressuring ring remains rotationally stationary relative to the drumhead when the tuning rod is turning about a long axis.

* * * * *